US005205775A

United States Patent [19]

Brodrib

[11] Patent Number: 5,205,775

[45] Date of Patent: Apr. 27, 1993

[54] AMBULATORY ANIMAL TOY

[76] Inventor: William A. Brodrib, 2700 SE. 7th Dr., Pompano Beach, Fla. 33062

[21] Appl. No.: 852,007

[22] Filed: Mar. 16, 1992

[51] Int. Cl.[5] ..... A63H 3/00

[52] U.S. Cl. ..... 446/317; 446/312; 446/375; 446/278; 446/384

[58] Field of Search ..... 446/317, 373, 375, 308, 446/309, 311, 312, 377, 379, 380, 370, 371, 382, 278

[56] References Cited

U.S. PATENT DOCUMENTS

| | | | |
|---|---|---|---|
| 1,308,816 | 7/1919 | Smith | 446/377 |
| 2,878,616 | 3/1959 | Sedlacek | 446/312 |
| 4,816,002 | 3/1989 | Brodrib | 446/373 |

FOREIGN PATENT DOCUMENTS

| | | | |
|---|---|---|---|
| 913277 | 6/1954 | Fed. Rep. of Germany | 446/317 |

*Primary Examiner*—Mickey Yu

*Attorney, Agent, or Firm*—Herbert L. Lerner; Laurence A. Greenberg

[57] ABSTRACT

An ambulatory animal toy has a skeleton which includes a substantially horizontal torso. The torso has forward and rear ends defining forward and rear directions. Mutually spaced apart front and hind legs are attached to the torso. Feet are attached to the legs, and the feet have friction pads or rubber soles. The torso is caused to bend substantially horizontally while it is prevented from bending substantially vertically when the skeleton is pulled. The torso is inherently resilient in the horizontal direction and inherently inflexible in the vertical direction. At least the hind legs are pivotally attached to the torso and are allowed to rotate about a substantially horizontal axis.

12 Claims, 6 Drawing Sheets

FIG. 3
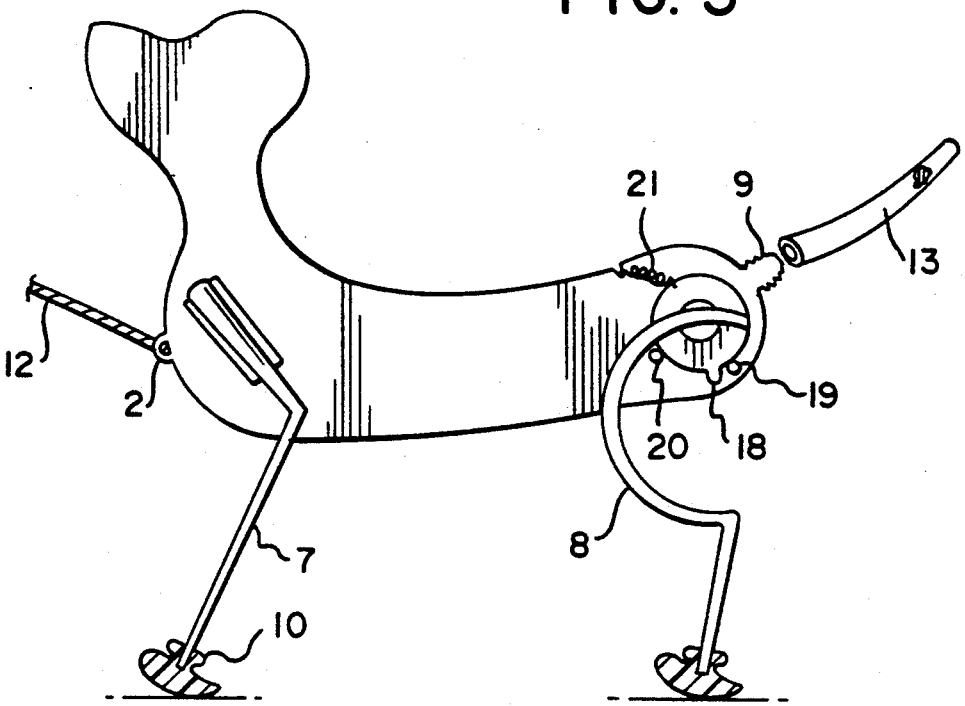
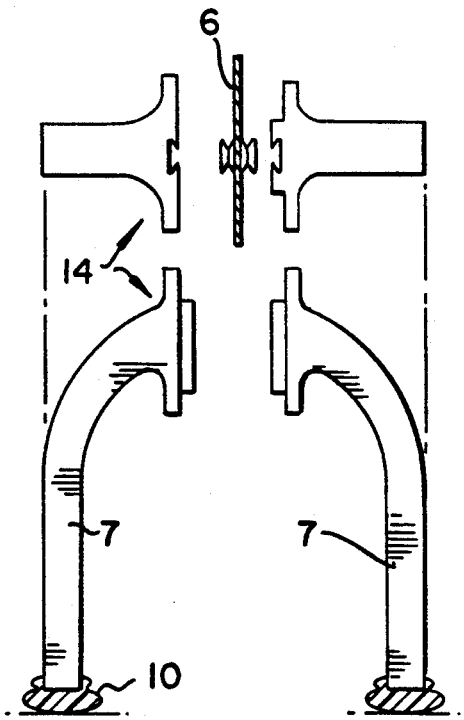
FIG. 4
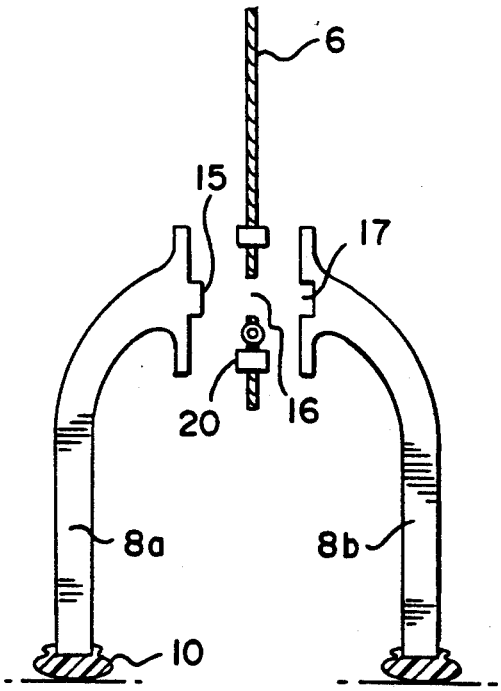
FIG. 5

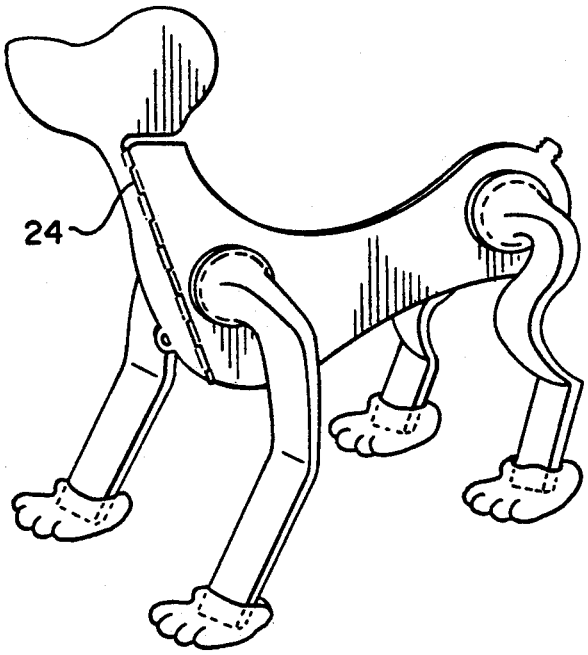
FIG. 12
FIG. 13a
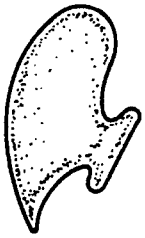
FIG. 13b
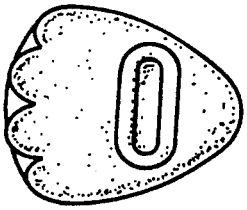
FIG. 13c
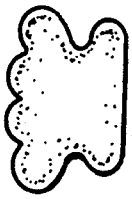
FIG. 14a.
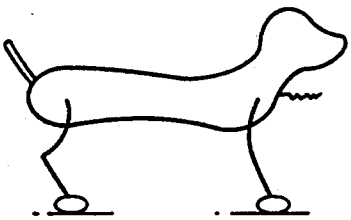
FIG. 15a
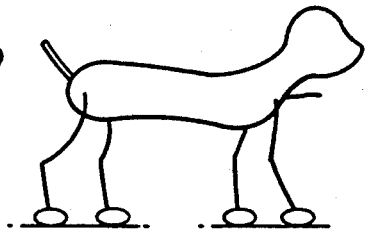
FIG. 16a
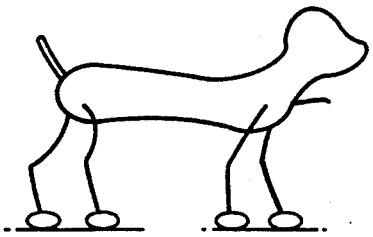
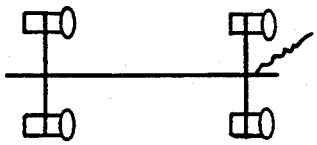
FIG. 14b
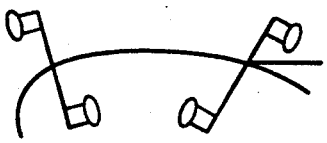
FIG. 15b
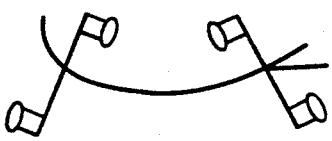
FIG. 16b

AMBULATORY ANIMAL TOY

BACKGROUND OF THE INVENTION

1. Field of the Invention

The invention relates to an ambulatory animal toy and more specifically to a toy which simulates the walking motion of a live animal when pulled due to a cooperation between a resilient spine and feet of the toy with a surface being walked upon.

2. Description of the Related Art

The invention described and claimed herein is mainly an improvement of the toy described in my U.S. Pat. No. 4,816,002, dated Mar. 28, 1989. Express reference is herewith made to that disclosure with respect to details which are not specifically described herein.

The legs of the prior art devices, including that disclosed in my afore-mentioned patent, were rigidly, non-pivotally attached to the body of the animal toy. Also, a great amount of stuffing was required, which often sagged within the skin and also restricted the proper walking motion. Furthermore, the bodies of the prior art devices, which may be formed of acrylic or spring steel, are either brittle or not fully resilient, i.e. they do not dependably return to their original shape.

SUMMARY OF THE INVENTION

It is accordingly an object of the invention to provide an ambulatory animal toy, which overcomes the hereinafore-mentioned disadvantages of the heretofore-known devices of this general type and which provides a vast improvement in the play value of the animal toy in that many different play positions are possible for the toy, such as standing, sitting, kneeling and lying, the stability and resiliency of the backbone is vastly improved and the amount of disadvantageous stuffing can be substantially reduced by providing a skeleton which resembles the shape of the finished toy more closely.

With the foregoing and other objects in view there is provided, in accordance with the invention, an ambulatory animal toy, comprising a skeleton including a substantially horizontal torso having forward and rear ends defining foreword and rear directions, mutually spaced apart front and hind legs attached to the torso, feet attached to the legs, means for providing friction between the feet and a walking surface, means for causing the torso to bend substantially horizontally while preventing the torso from bending substantially vertically when the skeleton is pulled, the means for causing the torso to wiggle and bend substantially horizontally while preventing the torso from bending substantially vertically comprising at least one piece of material incorporated in the torso being inherently resilient in the horizontal direction and inherently inflexible in the vertical direction, and means for pivotally attaching the hind legs to the torso and allowing rotation thereof about an axis substantially perpendicular to the forward and rear directions.

In accordance with an added feature of the invention, the ambulatory animal toy includes means for pivotally attaching the front legs to the torso and allowing rotation thereof about an axis substantially perpendicular to the forward and rear directions.

In accordance with an additional feature of the invention, the feet are at least partially formed of rubbery material forming the means for providing friction between the feet and the walking surface.

In accordance with another feature of the invention, the ambulatory animal toy includes spring means for biasing the rotatable hind legs into a substantially vertical position.

In accordance with a further feature of the invention, the ambulatory animal toy includes spring means for biasing the rotatable front and hind legs into a substantially vertical position.

In accordance with again another feature of the invention, the ambulatory animal toy includes hook means disposed at the forward end of the torso for attaching a leash to the animal toy.

In accordance with again an added feature of the invention, the hind legs are in the form of two legs and wherein the means for pivotally attaching the hind legs to the torso include rotator disks for pivotally supporting the legs on the torso and a rotating axle extending through a hole provided in the torso and rigidly connecting the two hind legs mutually opposite one another and clamping the torso in between.

In accordance with again a further feature of the invention, the ambulatory animal toy includes spring means attached to the rotator disks for providing a restoring torque and for biasing the hind legs in a substantially vertical position.

In accordance with yet a further feature of the invention, the front legs are in the form of two legs, including rotator disks for pivotally supporting the front legs on the torso and a rotating axle extending through a hole provided in the torso and rigidly connecting the two front legs mutually opposite one another and clamping the torso in between.

In accordance with yet an added feature of the invention, the ambulatory animal toy includes spring means attached to the rotator disks for providing a restoring torque and for biasing the front and hind legs in a substantially vertical position.

In accordance with a concomitant feature of the invention, the ambulatory animal toy includes means for attaching a leash to one of the rotator disks of the front legs for providing a restoring torque on the front legs into a substantially vertical position when the leash is pulled in the forward direction.

Other features which are considered as characteristic for the invention are set forth in the appended claims.

Although the invention is illustrated and described herein as embodied in an ambulatory animal toy, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 3 is a side-elevational view of a second embodiment of the invention;

FIG. 4 are two diagrammatic views of a slip joint for the stationary front legs of FIG. 3;

FIG. 5 is a front-elevational, exploded view of the rotatable hind legs and the body;

FIG. 12 is a perspective view of the invention with a hinge allowing sideways rotation of the head;

FIGS. 13*a*–13*c* are three elevational views of a paw according to the invention; and FIGS. 14*a*–16*a* and 14*b*–16*b* are three side-elevational and corresponding top-plan views in different phases of the walking motion.

DESCRIPTION OF THE PREFERRED EMBODIMENTS

Figure 1:
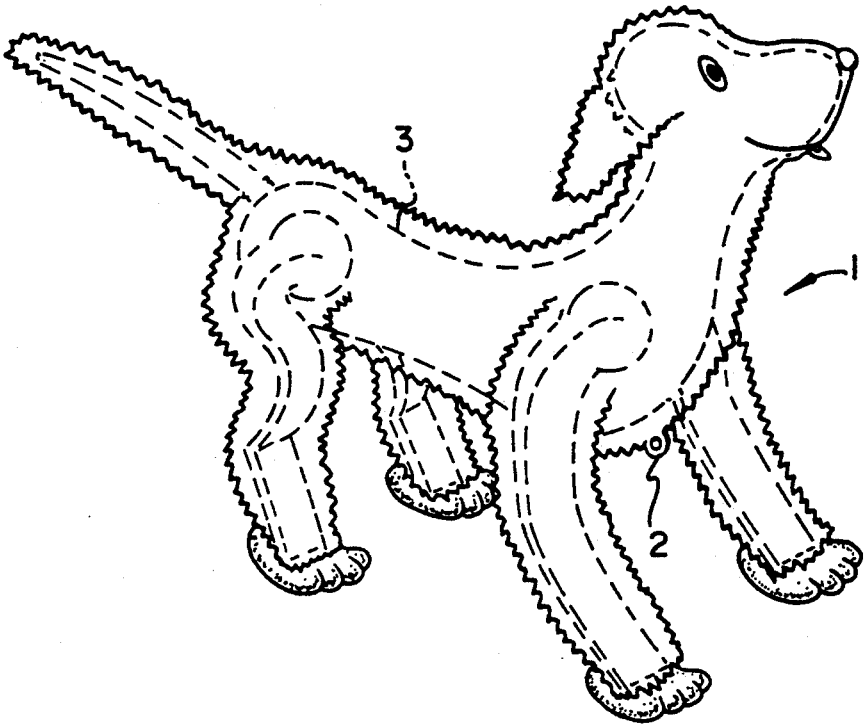
FIG. 1 is a perspective view of a toy dog according to the invention, showing the skeleton in dashed lines.
Figure 2:
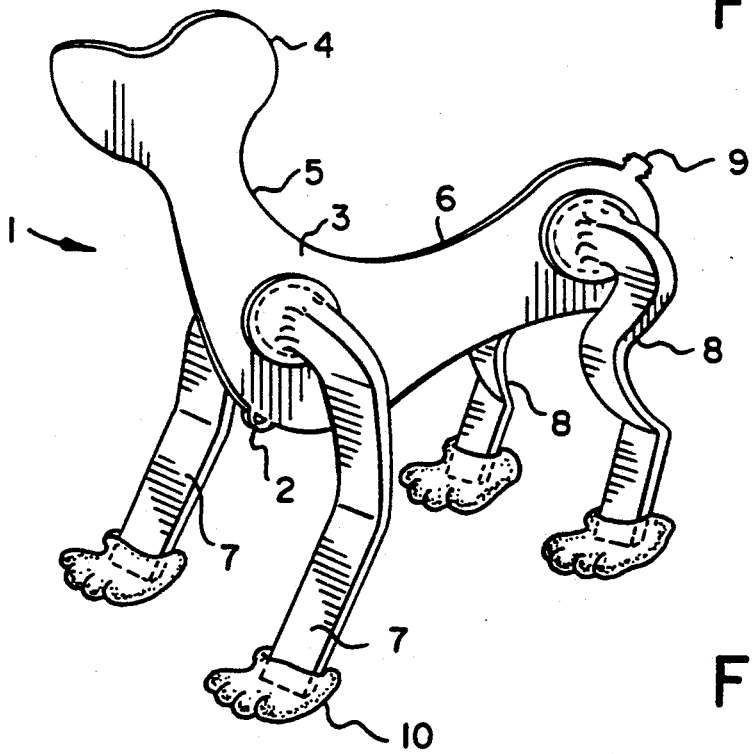
FIG. 2 is a perspective view of a first embodiment of the skeleton corresponding to FIG. 1.

Referring now to the figures of the drawing in detail and first, particularly, to FIGS. 1 and 2 thereof, there is seen a stuffed toy dog 1. It is noted that, while a dog is shown throughout this specification, this application is not limited to that animal, since only minor modification would be necessary to provide a different toy animal. A loop 2 can be used to attach a string for pulling the dog. A skeleton 3, which is shown in detail in FIG. 2, is indicated with dashed lines.

The skeleton 3 includes the main anatomical parts of the animal, namely a head 4, a neck 5, a torso 6, front legs 7 and hind legs 8. An attachment stub 9 for a tail is provided on the rear of the torso. Feet or paws 10 are attached at the bottom of the legs 7 and 8.

The dimensions of the toy animal depend on the animal being copied. In the case of a dog, the preferred dimensions are in the following range: The body has ½ the thickness of the legs and twice their width. The average body length and height are 12 to 15 inches. The width between the shoulders is about 8 to 10 inches.

As compared to the skeleton of the stuffed animal in my above-mentioned patent, the body and the legs of the improvement now are more closely related to the natural form of the animal. The parts may be manufactured by injection molding or any other suitable process of plastics forming. The presently most preferable material from which to form the skeleton is a polycarbonate such as a plastic commercially available under the name Lexan®.

Also, due to the ready moldability of the plastic, it may not be necessary to add any stuffing to the animal. For example, in the case of a long-haired dog, in which case the skin may be made relatively stiff, no stuffing or only a limited amount thereof will be necessary.

Casting the body allows for various degrees of thickness in different locations. For example, the shoulders which form part of the legs 7 and 8 may be made thicker than the rest of the legs. Such considerations will be based on the requirement whether a certain part of the body is to be made bendable or rigid. Also, while the legs may be slightly elastic in the preferred embodiment, this is not a requirement.

The main difference between the embodiments of FIGS. 2 and 3 lies in the fact that the front legs 7 of the latter are rigidly connected to the torso 6. The legs 7 may even be cast in one mold with the body 6. A string or leash 12 is shown attached to the loop 2 and a tail 13 is shown adjacent the tail attachment stub 9. The tail 13 may be of any resilient material and it has been found that simple rubber hose material best resembles a naturally wagging tail when the toy animal is in motion.

As shown in FIG. 4, the front legs 7 may be attached to the body 6 with a simple slip joint 14, which is shown in a front and top plan view. The joint 14 provides a form lock. It is noted in this context that a form-locking connection is one which connects two elements together due to the shape of the elements themselves, as opposed to a force-locking connection, which locks the elements together by force external to the elements. The joint 14 is well within the general skill in the mechanical arts and no further explanation is deemed necessary.

Also, the individual legs need not be connected by a force or form lock, but may instead by rigidly joined by heat shrinking, welding, compression, etc. In many cases such manufacturing choices will depend on whether it is deemed more efficient to insert the body parts in almost completely sewn skin rather than placing the skin over the completely assembled skeleton.

Figure 6:
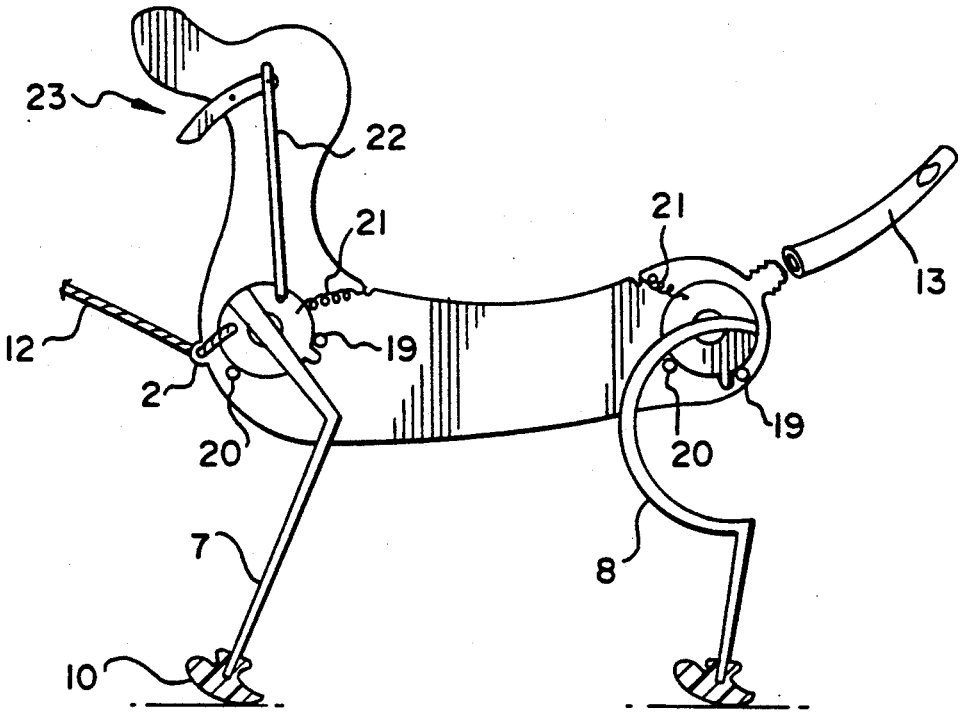
FIG. 6 is a side-elevational view of a third embodiment of the invention.
Figure 7:
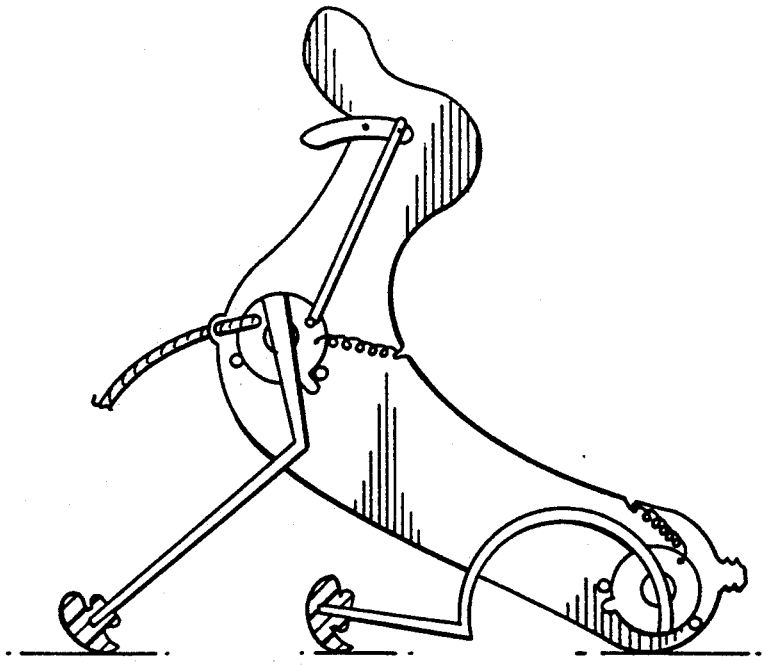
FIG. 7 is a view of the embodiment of FIG. 6 in a sitting position.
Figure 8:
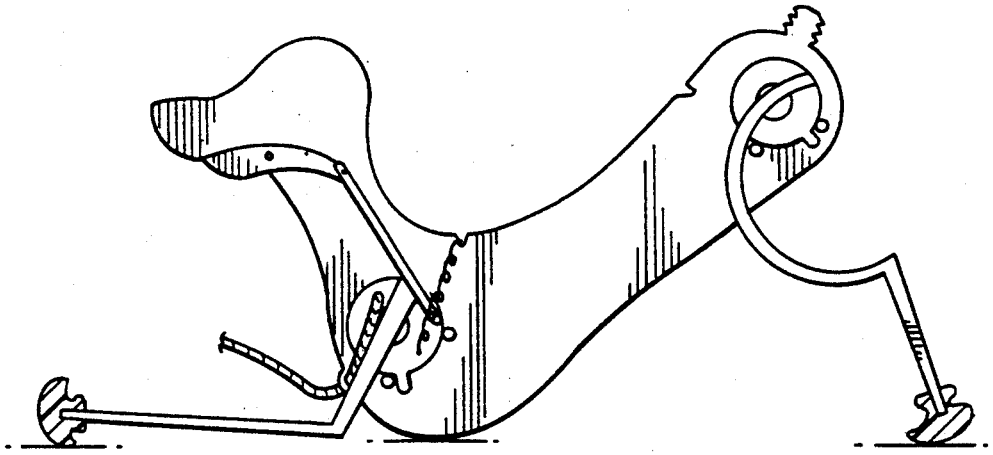
FIG. 8 is a view of the embodiment of FIG. 6 in a position which resembles a dog playing with a bone.
Figure 9:
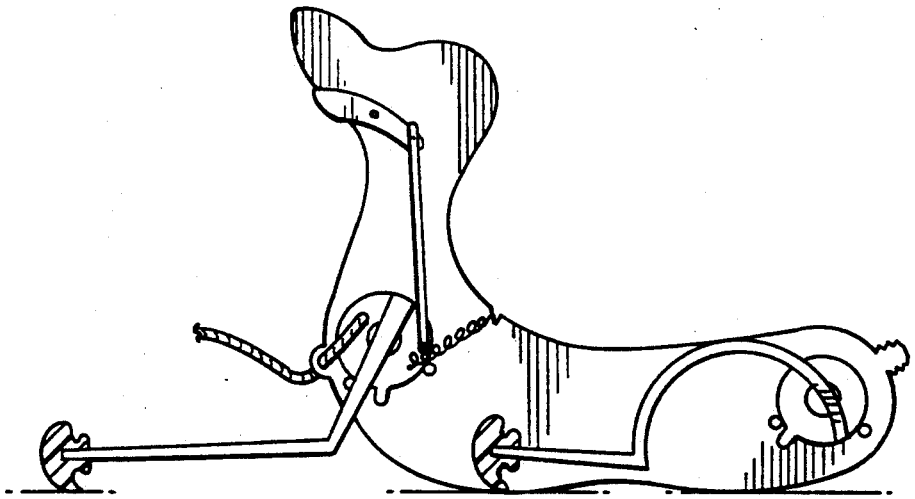
FIG. 9 is a view of the embodiment of FIG. 6 in a position which resembles a sitting guard dog.

The hind legs 8 are connected to the body 6 by a rotator joint formed of rotator disks and rotating axles. A knob 15 of the hind leg 8*a* which forms the rotating axle extends through an opening 16 provided in the body 6. The knob 15 snaps into a recess 17 provided in the hind leg 8*b*. The snap action is such that the body 6 is clamped in between the legs 8*a* and 8*b*, without restricting the rotation thereof on the body 6. A tab 18 is provided on the rotator which cooperates with stops 19 and 20 attached to the body 6. It is self-evident that the stop 19 prevents the legs 8 from bending back beyond a substantially vertical position (FIGS. 3 and 6) and the stop 20 prevents the legs 8 from bending forward beyond a substantially horizontal position (FIGS. 7 and 9).

A restoring or biasing spring 21 is attached to the rotator on the hind legs 8. The spring 21 provides a restoring torque which partly counteracts the gravitational force on the body 6 and thus helps to stand up the animal. A similar restoring spring 21, as well as stops 19 and 20, are provided with the rotator of the front legs 17, in case they are rotateable on the body.

In the embodiment shown in FIGS. 6–9, the leash 12 for pulling the animal is attached to the rotator of the front legs 7. When the animal is pulled from the positions shown in FIGS. 8 and 9, the string 12 provides an additional restoring torque on the rotators of the legs 7, thus helping the animal to stand up.

The front leg rotator is further connected to a jaw operating mechanism 22, which opens and closes the mouth 23 depending on the position of the front legs 7. As illustrated, the mouth 23 is open in FIGS. 6 and 7, while it is closed in FIGS. 8 and 9.

Figure 10:
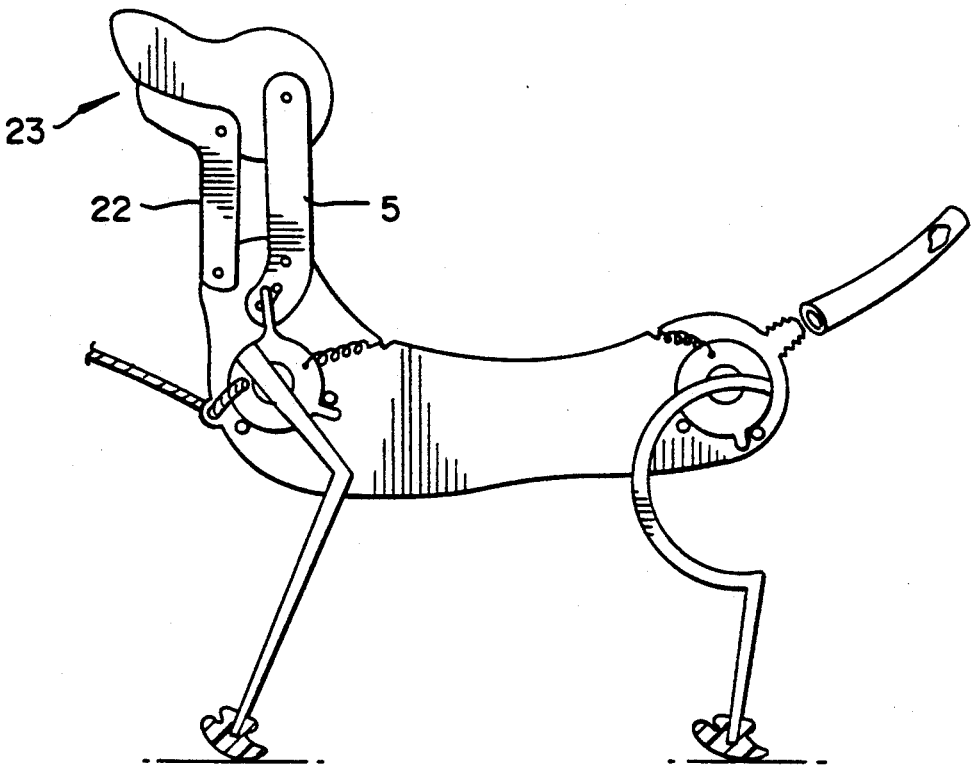
FIG. 10 is a side-elevational view of a fourth embodiment having a movable neck.
Figure 11:
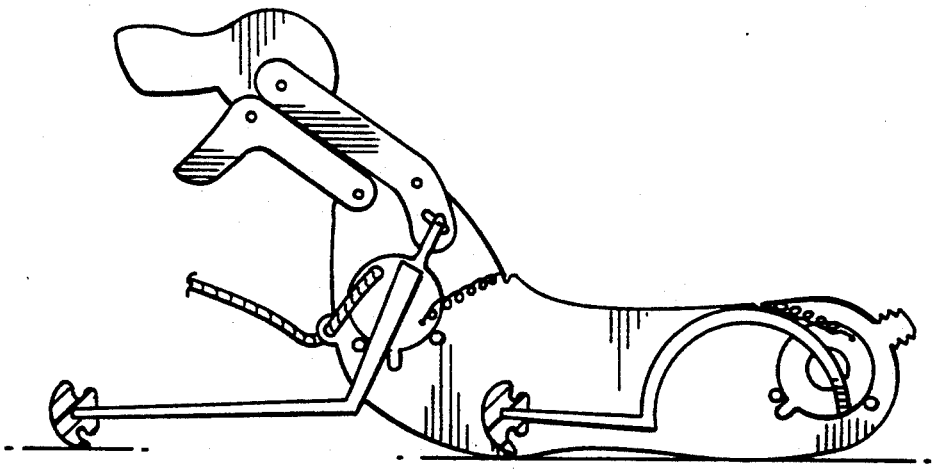
FIG. 11 is a sitting view of the dog of FIG. 10 with an open jaw.

The embodiment of the invention shown in FIGS. 10 and 11 provides for the head to remain substantially horizontal both in the walking and lying positions. The neck 5 comprises a parallelogram-type dual connection between the body and the head of the animal. In contrast to the embodiment of FIGS. 6–9, the mouth 23 remains shut when the animal stands and it is open when the animal lies down.

Animated mouth movements are especially important when the animal is provided with sound electronics. For instance, a dog may be provided with a device which emits barking noise and a cat may emit purring or miaow sounds.

A further embodiment of the invention is indicated in FIG. 12. The head 4 of the animal is attached to the body 6 by means of a hinge which allows the head to wiggle about a substantially vertical axis. Such motion of the head is effected by the wiggling walking motion of the animal as well as the direction the leash is pulled.

The paws 10 are quite important for the proper functionality of the stuffed animal. As shown in FIG. 13*a*, the sole of the paw 10 is rounded so as to provide are partial rolling motion. The sole is formed of material which provides a sufficient degree of friction on the walking surface. The curvature of the paws should be such that the friction surface remains in contact during all playing positions shown in FIGS. 6–9. For example, if the animal is pulled from the position shown in FIG. 9, the legs 7 and 8 will move to a vertical position, i.e. the animal will stand up. The standing-up forces are then a combination of the pulling force on the leash, the torque on the forward rotator disk due to the leash, the biasing torque due to the springs 21, and the static frictional forces between the feet 10 and the walking surface. The feet may be formed of a rubber body surrounding a metal weight, such as disclosed in U.S. Pat. No. 2,663,970.

The covering for the toy includes a skin formed of a suitable fabric and, possibly, stuffing within the skin surrounding the skeleton. The determination of covering and stuffing requirements are entirely left to the person of skill in the art. The only mechanically important feature is the requirement that the dressing does not interfere with the proper function of the walking animal.

In order to describe the simulated walking motion of the toy, reference will be made to FIGS. 14*a*16*b*. The skeleton 3 of the toy is in a position of repose shown in side and top views in FIGS. 14*a* and 14*b*, before the leash 12 is pulled. As best understood, as the leash 12 is pulled forward, the left front and right rear feet lose their frictional engagement with the floor or walking surface and snap forward due to the pendular motion, which is described in more detail in my U.S. Pat. No. 4,816,002. The other two feet actually move slightly backward. This can be seen by comparing the positions of the feet in FIGS. 15*a* and 15*b* with that shown in FIGS. 14*a* and 14*b*, relative to vertical and horizontal center lines shown in the figures. It is important to note that the spine of FIGS. 15*a* and 15*b* bends horizontally but not vertically. A slight torsional motion of the spine allows two diagonally opposite feet to rise above the floor or walking surface and the fact that the wide surfaces of the legs face forward permits the two diagonally opposite legs to bend forward. Upon continued pulling on the leash 12, the left front and right rear feet frictionally engage the floor at a new location, while the other two feet lose their frictional engagement due to the torsional motion described above and snap forward to a new position as seen in FIGS. 16*a* and 16*b*. These motions are repeated as the toy is pulled, simulating walking. The movement of the toy will simulate that of a trotting horse with diagonally opposite feet being lifted together, as opposed to a galloping or pacing horse.

I claim:

1. An ambulatory animal toy, comprising a skeleton including a substantially horizontal torso having forward and rear ends defining forward and rear directions, mutually spaced apart front and hind legs attached to said torso, feet attached to said legs, means for providing friction between said feet and a walking surface, means for causing said torso to bend substantially horizontally while preventing said torso from bending substantially vertically when said skeleton is pulled, said means for causing said torso to bend substantially horizontally while preventing said torso from bending substantially vertically comprising at least one piece of material incorporated in said torso being inherently resilient in the horizontal direction and inherently inflexible in the vertical direction, and means for pivotally attaching said hind legs to said torso and allowing rotation thereof about an axis substantially perpendicular to said forward and rear directions between a repose position in which said hind legs extend substantially horizontally and a standing position in which said hind legs extend substantially vertically relative to the walking surface.

2. The ambulatory animal toy according to claim 1, including means for pivotally attaching said front legs to said torso and allowing rotation thereof about an axis substantially perpendicular to said forward and rear directions.

3. The ambulatory animal toy according to claim 1, wherein said feet are at least partially formed of rubbery material forming said means for providing friction between said feet and the walking surface.

4. The ambulatory animal toy according to claim 1, including spring means for biasing said rotatable hind legs in a substantially vertical position.

5. The ambulatory animal toy according to claim 2, including spring means for biasing said rotatable front and hind legs in a substantially vertical position.

6. The ambulatory animal toy according to claim 1, including a hook means disposed at the forward end of said torso for attaching a leash to the animal toy.

7. The ambulatory animal toy according to claim 1, wherein said hind legs are in the form of two legs and wherein said means for pivotally attaching said hind legs to said torso include rotator disks for pivotally supporting said legs on said torso and a rotating axle extending through a hole provided in said torso and rigidly connecting said two hind legs mutually opposite one another and clamping said torso in between.

8. The ambulatory animal toy according to claim 7, including spring means attached to said rotator disks for providing a restoring torque and for biasing said hind legs in a substantially vertical position.

9. The ambulatory animal toy according to claim 7, wherein said front legs are in the form of two legs, including rotator disks for pivotally supporting said front legs on said torso and a rotating axle extending through a hole provided in said torso and rigidly connecting said two front legs mutually opposite one another and clamping said torso in between.

10. The ambulatory animal toy according to claim 9, including spring means attached to said rotator disks for providing a restoring torque and for biasing said front and hind legs in a substantially vertical position.

11. The ambulatory animal toy according to claim 9, including means for attaching a leash to one of said rotator disks of said front legs for providing a restoring torque on said front legs into a substantially vertical position when the leash is pulled in the forward direction.

12. The ambulatory animal toy according to claim 1, including spring means for assisting standing up from the repose position to the standing position and for biasing said hind legs in the standing position.

* * * * *